United States Patent [19]

Francis

[11] 4,084,316

[45] Apr. 18, 1978

[54] SAFETY RAZORS

[75] Inventor: John Frederick Francis, Horsell, England

[73] Assignee: The Gillette Company, Boston, Mass.

[21] Appl. No.: 748,761

[22] Filed: Dec. 8, 1976

Related U.S. Application Data

[62] Division of Ser. No. 618,634, Oct. 1, 1975, abandoned.

[30] Foreign Application Priority Data

Oct. 8, 1974 United Kingdom ..... 43528/74

[51] Int. Cl.[2] ..... B26B 21/22; B26B 21/52

[52] U.S. Cl. ..... 30/47; 30/85; 30/50

[58] Field of Search ..... 30/47, 50, 85, 346.57, 30/346.58, 346.59

[56] References Cited

U.S. PATENT DOCUMENTS

| | | | |
|---|---|---|---|
| 1,840,199 | 1/1932 | Hoff | 30/346.57 |
| 3,660,893 | 5/1972 | Welsh | 30/50 |
| 3,703,766 | 11/1972 | Tibbals | 30/346.58 X |
| 3,842,499 | 10/1974 | Dorion | 30/50 |
| 3,849,882 | 11/1974 | Ferraro | 30/50 X |
| 3,918,155 | 11/1975 | Atkins | 30/85 X |
| 3,940,853 | 2/1976 | Francis | 30/50 X |

*Primary Examiner*—Gary L. Smith

*Attorney, Agent, or Firm*—Richard A. Wise; Oistein J. Bratlie; Scott R. Foster

[57] ABSTRACT

A shaving unit comprises a narrow single edged blade strip and a frame having a support portion having a flat surface to which the blade is permanently secured over its full length.

8 Claims, 10 Drawing Figures

SAFETY RAZORS

This is a divisional of application Ser. No. 618,634, filed Oct. 1, 1975, now abandoned.

This invention relates to improvements to safety razors.

Conventional safety razor blades have a substantial width perpendicular to the cutting edge and are held in position in the razor by clamping them between members which engage opposite surfaces of the blade itself. It has been proposed to replace such blades by very narrow blade strips, which, as well as being economical of material, are easily rinsed clean after use and can be so mounted as to have a desirably greater degree of flexibility than conventional blades. To give the narrow blade strips adequate rigidity, it has been proposed to hold them under longitudinal tension and/or to impart a special cross-sectional shape to the blade strip. The present invention provides an improved manner of mounting a very narrow blade strip which gives it greater rigidity than a tensioned blade strip.

In accordance with the invention there is provided a shaving unit comprising a narrow elongated blade strip sharpened along one longitudinal edge and an elongated support member which is of greater length than the blade strip, and which is formed over a length at least equal to that of the blade strip with a substantially flat surface, one face of the blade strip being secured along its length to the said surface of the support member with the cutting edge of the blade projecting clear of the support member, the support member including projecting portions which form a means for securing the blade unit in a razor.

Some embodiments of the invention will now be described by way of example with reference to the accompanying drawings in which.

Figure 1:
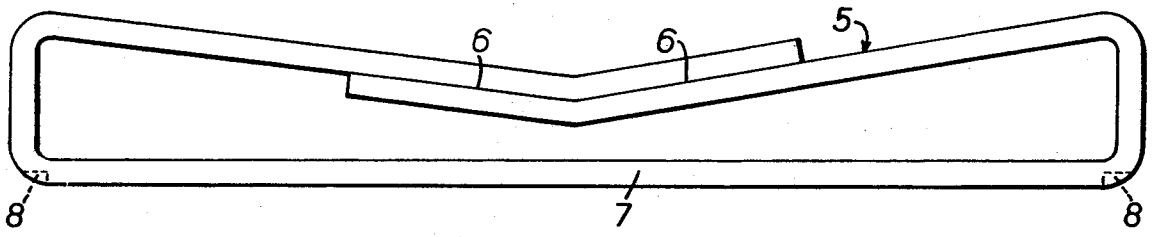
FIG. 1 is a plan view of a wire frame member.

The form wire frame 5 shown in FIG. 1, a length of round section stainless steel wire 0.032 inch (0.81 mm) in diameter is bent to the form shown and its overlapped ends are secured together by spot welding, as at points 6. The wire of the frame is then flattened in a press, giving it a thickness perpendicular to the plane of the frame of 0.024 inch (0.61 mm) and a transverse dimension which is somewhat greater, approximately 0.034 inch (0.88 mm). The press tools are shaped so as to produce at the ends of the under-surface of straight front portion 7 of the frame a pair of recesses 8.

Figure 2:
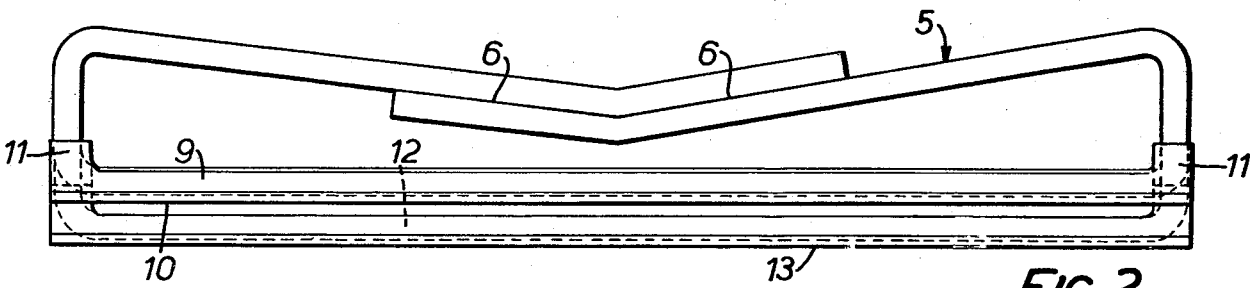
FIG. 2 is a plan view of a blade assembly including two such wire frames, each carrying a blade strip.

A blade strip 9 (FIG. 2) is then applied to the top surface of the portion 7 and secured to the frame by projection welding. The blade strip, which has its front longitudinal edge 10 sharpened to a cutting edge, has over the greater part of its length a width of 0.040 inch (1.0 mm) but has portions 11 of greater width at its two ends.

A second wire frame 12, similar to the frame 5 except that it is of greater width from back to front (top to bottom of the figure) and has no recesses 8, is similarly formed and attached to a second blade strip 13, similar to the blade strip 9. The two wire frames are superimposed, the recesses 8 in the upper frame accommodating the ends of the lower blade strip 13, and secured together by spot welding to form the tandem blade assembly shown in FIG. 2.

Figure 3:
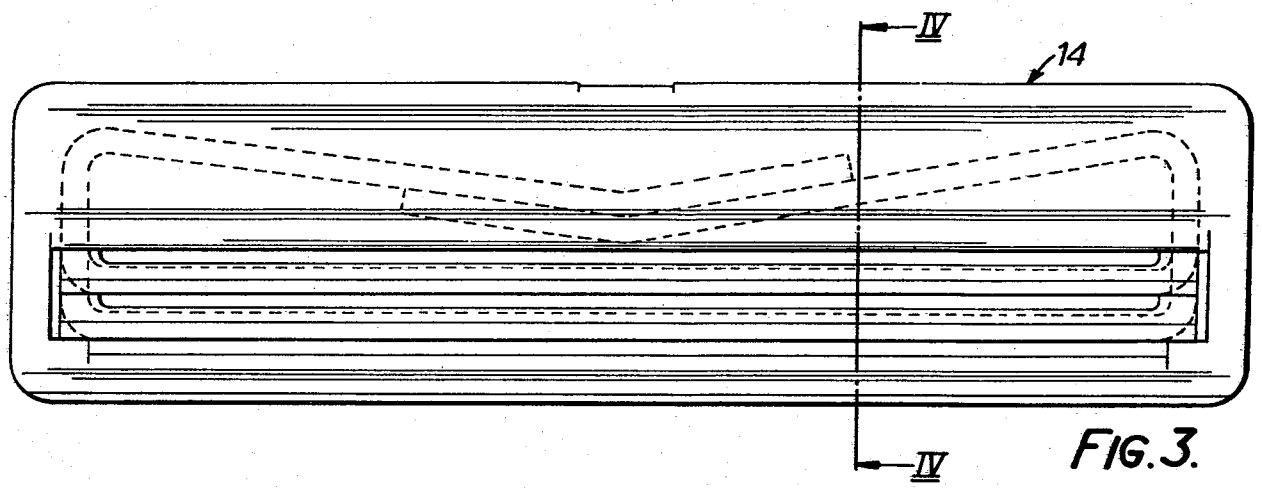
FIG. 3 is a plan view of a shaving unit including the blade assembly of FIG. 2.
Figure 4:
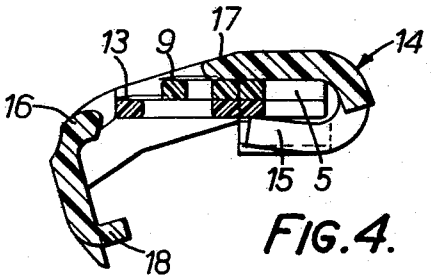
FIG. 4 is a cross-section taken on the line IV—IV of FIG. 3.

This blade assembly is then inserted into a housing or cartridge 14 to form the complete shaving unit shown in FIGS. 3 and 4. This housing is formed of aluminium and has a portion 15 which is deformed as shown in FIG. 4 to hold the blade assembly securely in position by clamping the rear portions of the wire frames 5 and 12 with the cutting edges of the two blade strips 9 and 13 exposed between a guard surface 16 and a cap surface 17 afforded by other parts of the housing 14. The housing also includes a depending front portion 18 which serves for detachably connecting the shaving unit to a handle (not shown) to form a complete razor. The handle may be generally similar in construction to that shown in FIG. 5.

Figure 5:
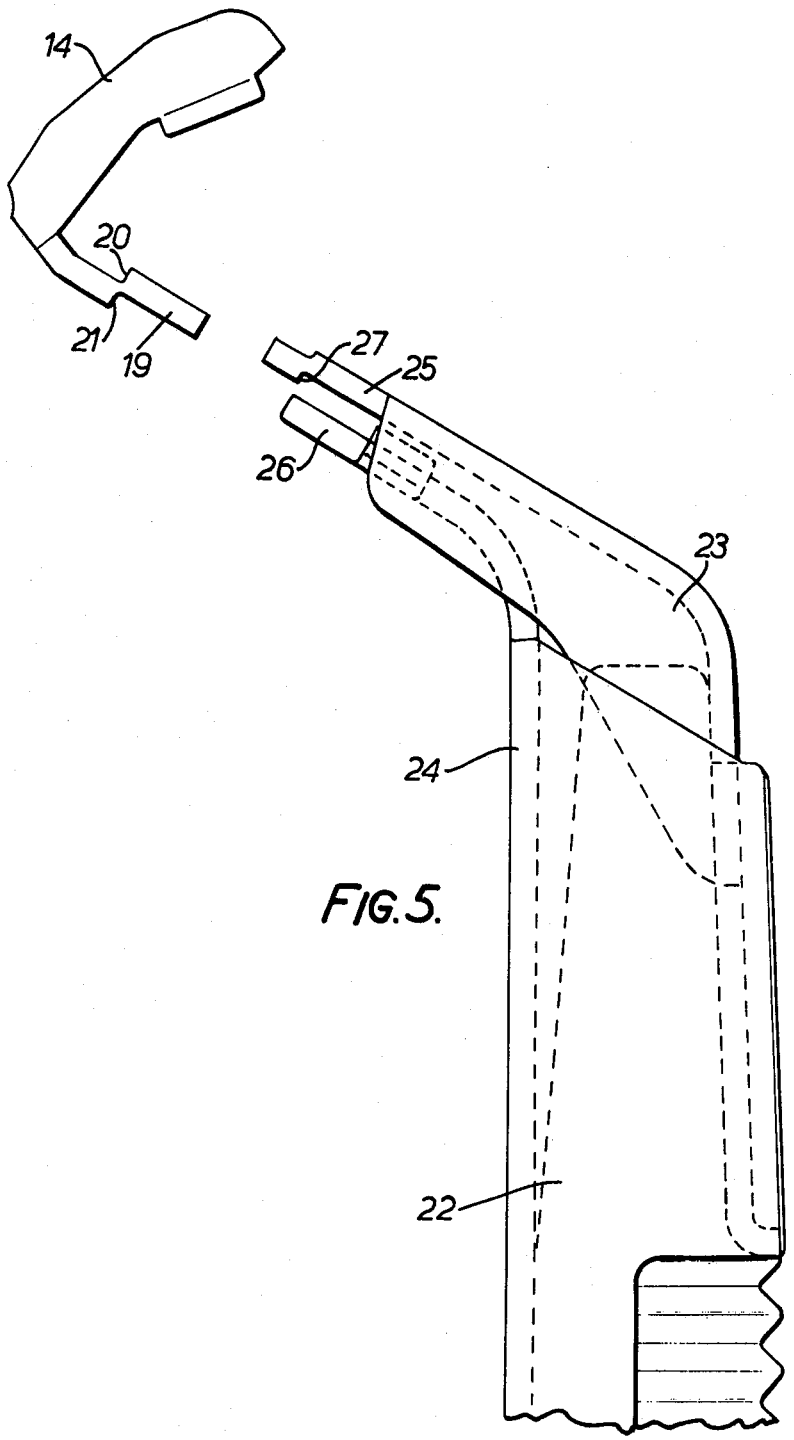
FIG. 5 is an end view of a slightly modified form of the shaving unit of FIGS. 3 and 4 and of the upper part of a cooperating handle.

FIG. 5 shows a shaving unit which is identical with that of FIGS. 3 and 4 except for the form of the depending front portion of the housing. In FIG. 5 this front portion 19 is stepped or cranked to provide an upwardly facing shoulder 20 on the rear face and a downwardly facing shoulder 21 on the front face. The handle, whose upper part only is shown in FIG. 5, for detachably holding this shaving unit comprises a stem or hand grip 22 whose upper end is secured to two sheet metal members 23, 24 which project upwardly and forwardly from the stem and terminate in jaws 25, 26 respectively. The upper, rear jaw 25 is longer than the lower jaw 26 and is stepped or cranked to provide a shoulder 27. To couple the shaving unit to the handle, the lower part of the portion 19 is slidably engaged between the jaws of the handle and is located and retained by the engagement of the shoulder 27 with the shoulder 20 and of the extremity of jaw 26 with the shoulder 21. The gap between the jaws is normally slightly less than the thickness of the portion 19, so that the jaws resiliently grip the portion 19. The portion 19 and one or both jaws of the handle may be formed with cooperating projections and recesses adapted to interengage when the shaving unit is centrally positioned on the handle, thus preventing unintended relative sliding movement during use, while permitting ready disengagement when it is desired to replace the unit by a fresh one.

The particular embodiment of the invention which has been described above is intended by way of example only and many modifications are possible, including the following. The wire frames which support the blade strips may be substantially rectangular, instead of having their rear parts V-shaped as shown. They may be of the same size, instead of different sizes, though the arrangement shown facilitates assembly into a cartridge. The blade strip supporting wires do not necessarily have the form of a closed loop: the two ends of the wire may be spaced apart. Instead of making the supports by pressing circular section wire and securing the blade strips by projection welding, the supports may be made from square section wire and the blade strips resistance welded to them. Other methods of securing the blade strips are also possible. The blade strips may be of uniform width throughout their length. The cartridge housing may be made of material other than aluminium, such as a plastics material, and may have other forms than that shown; in particular, it may have different means for connecting it to a handle. Means other than those shown may be adopted for securing the blade strip supports in the cartridge housing. For example the side portion of frame shaped supports, instead of the rear portions, may be clamped. In suitable cases the supports may be secured by welding them to the housing. The dimensions given may be varied. The invention is not limited to blade strips mounted in tandem pairs, nor to blade strips which form part of a disposable shaving unit adapted for detachable connection to a handle. Blade strips mounted in accordance with the invention, either singly or in tandem pairs, could be arranged for insertion in and removal from a razor frame which provides the guard surface as well as the handle. On the other hand, the blade strips of the invention could be permanently secured to a unitary or composite structure forming a complete razor, which will be discarded as a whole when the blade strips are no longer fit for use.

Figure 6:
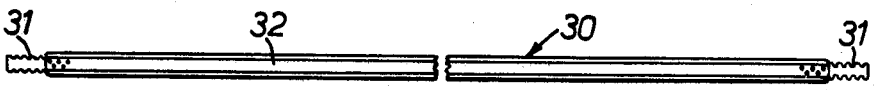
FIG. 6 is a plan view of an alternative form of wire support member.
Figure 7:
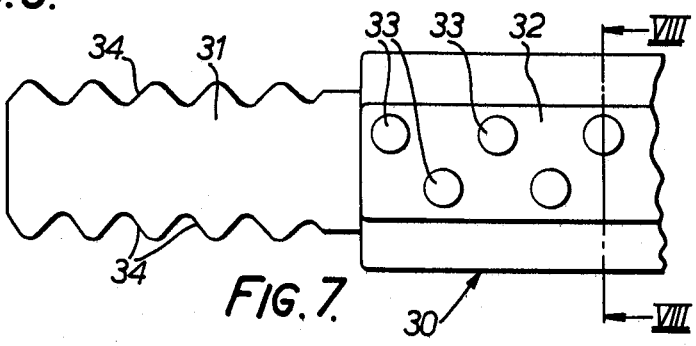
FIG. 7 is a greatly enlarged plan view of one end of the member of FIG. 6.
Figure 8:
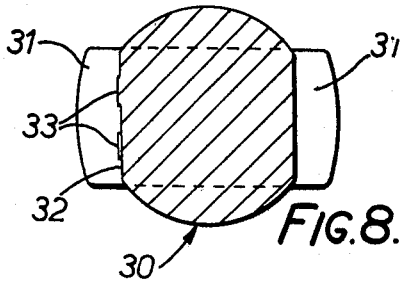
FIG. 8 is a cross-section on the line VIII—VIII of FIG. 7.

Some of these possible modifications are embodied in the alternative construction described below with reference to FIGS. 6 to 10. The blade strip support 30 shown in FIGS. 6 to 8 is formed from a straight length of circular section wire 0.71 mm in diameter, the full length of which, except for the two extreme end portions 31, is pressed to a thickness of 0.61 mm, increasing the transverse dimension to about 0.74 mm. The press tool engaging the upper surface is formed with recesses into which the metal of the wire is upset, producing on the flattened upper surface 32 of the wire a multiplicity of small projections 33 measuring some 0.16 mm in diameter and some 0.012 mm in height. The two end portions 31 of the wire, each about 1 mm in length, are flattened transversely, reducing their transverse dimension to about 0.55 mm and increasing their thickness to some 0.864 mm and at the same time forming serrations 34 on the side faces of the end portions. A blade strip 35 (FIG. 10) similar to those of the embodiment first described is secured to upper surface of each wire support by projection welding, the blade strip extending over the full length of the flattened portion 32, having only the end portions 31 projecting beyond the ends of the blade strips.

Figure 9:
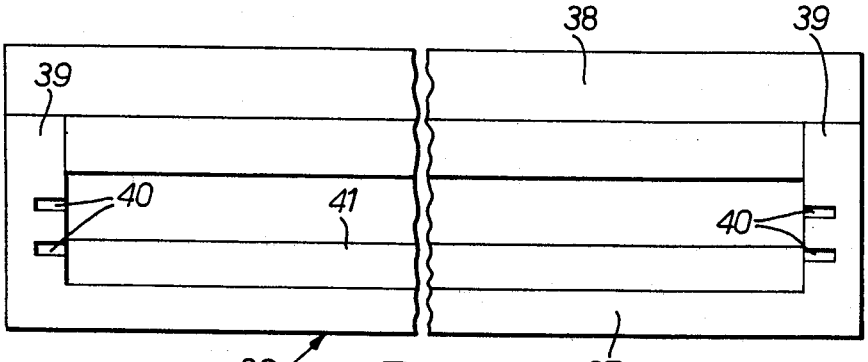
FIG. 9 is a plan view of a housing for the member of FIGS. 6 to 8.
Figure 10:
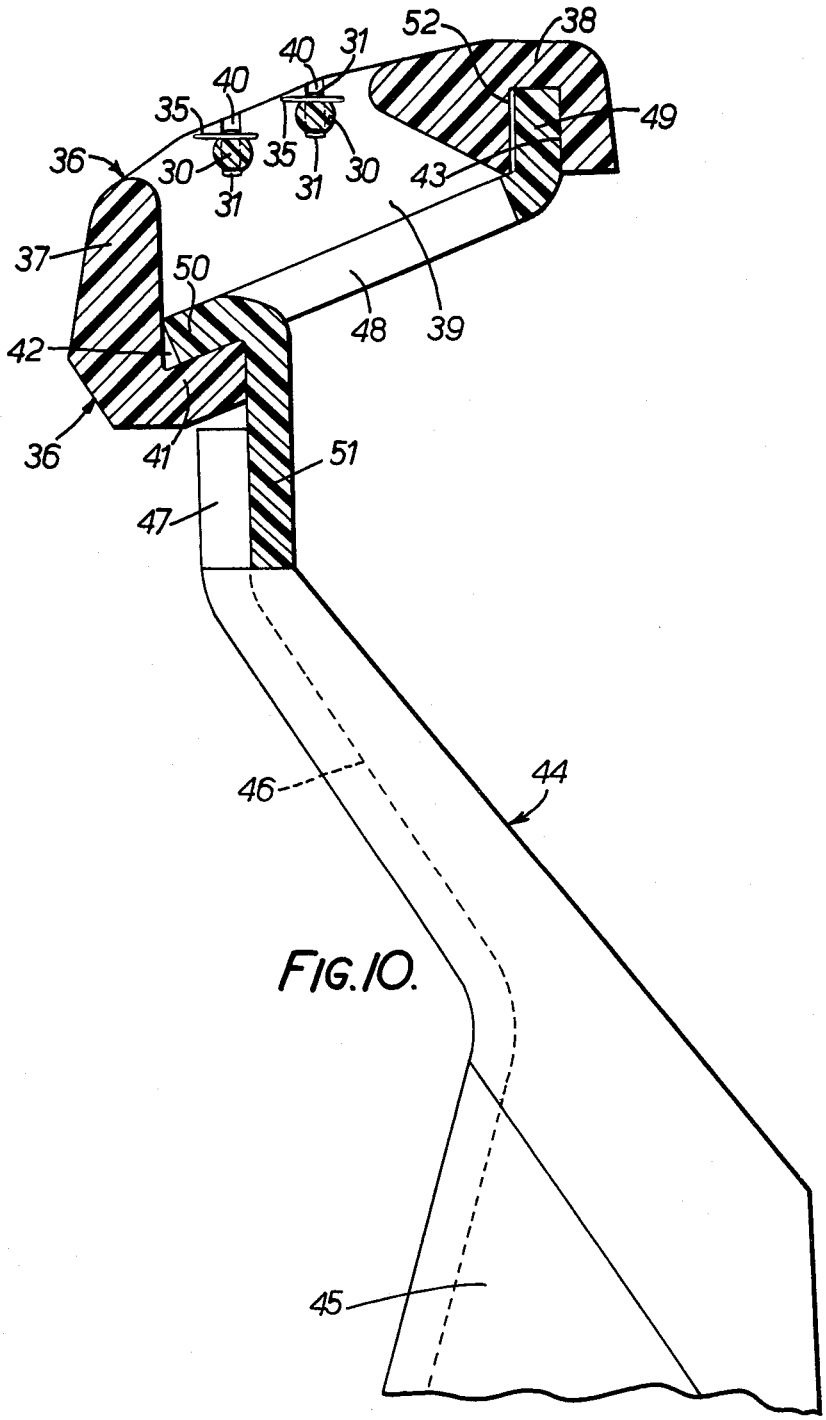
FIG. 10 is a sectional side view of a shaving unit including the parts shown in FIGS. 6 to 9 and of the upper part of a cooperating handle.

The housing 36 shown in FIGS. 9 and 10 is a unitary moulding of plastics material, so designed that it can be formed in a simple two part mould. It has the general form of a rectangular frame comprising a front member 37, a rear member 38 and end members 39. The inner face of each end member is formed with two slots 40 extending downwardly from the upper surface and the serrated end portions 31 of two support wires 30 each carrying a blade strip 35 are forced into those slots, thus securing the blade strips at the desired angle in the housing with their cutting edges parallel to one another and to the front member 37 of the housing, which is shaped to provide a guard suface for the cutting edge of the leading blade strip. The front member 37 includes a rearwardly projecting flange 41 which in conjunction with the under surface of the end members 39 provides a rearwardly facing longitudinal channel 42 and a downwardly facing channel 43 is formed in the rear member 38 of the housing. These channels constitute the coupling elements for detachably securing to a handle the shaving unit constituted by the housing and the two wire-supported blade strips.

The handle 44 shown in FIG. 10 for use with such shaving units comprises a stem or hand grip 45 (only the upper extremity of which is shown in the figure) at whose upper end is a forwardly and upwardly projecting portion 46, terminating in a metal tongue 47. Secured by welding to this tongue is a sheet metal head 48 having a length (perpendicular to the plane of the figure) substantially equal to that of the shaving unit. The rear margin of the head is bent upwardly to form a rail 49 adapted to engage in the downwardly facing channel 43 of the shaving unit while the front margin of the head forms a rail 50 adapted to engage in the rearwardly facing channel 42 of the shaving unit. A tongue 51 formed intermediate these rear and front rails is bent down and secured to the tongue 47 at the top of the stem. The shaving unit is readily engaged with and disengaged from the handle by relative longitudinal sliding movement. A rib 52 projecting from the front wall of the downwardly facing channel at the center of its length engages resiliently with a groove formed in the front face of the upwardly projecting rail of the handle when the shaving unit is centrally located on the handle, thus assisting correct location of the shaving unit and preventing accidental displacement during use, while allowing ready removal of the shaving unit from the handle when desired.

Instead of providing the housing 36 with coupling means for detachably securing it upon a handle, the housing could be permanently attached to, or formed integral with, a suitable hand grip portion, thus constituting a disposable razor.

Having thus described my invention, what I claim as new and desire to secure by Letters Patent of the United States is:

1. A shaving unit comprising narrow elongated blade means having a cutting edge means thereon, frame means including a thin elongated first portion, a thin elongated second portion, said first and second portions being joined by thin elongated end portions, said first, second and end portions defining a slot therebetween, said first portion having a support portion having a substantially flat surface thereon, said blade means being permanently secured over its full length to said surface and being over its full length adjacent thereto, said cutting edge means projecting clear of said support portion, and metal housing means disposed about said frame means and retaining said frame means and said blade means therein, said housing means providing a guard surface extending parallel to said blade means, said frame means including mounting portions retained in said housing by a deformed portion of said housing clamped about said mounting portions.

2. A shaving unit in accordance with claim 1 and including a handle unremovably secured to said housing.

3. A shaving unit comprising narrow elongated blade means having a cutting edge means thereon, frame means including a thin elongated first portion, a thin elongated second portion, said first and second portions being joined by thin elongated end portions, said first, second and end portions defining a slot therebetween said first portion having a support portion having a substantially flat surface thereon, said blade means being permanently secured over its full length to said surface and being over its full length adjacent thereto, said cutting edge means projecting clear of said support portion, and plastic housing means disposed about said frame means and retaining said frame means and said blade means therein, said housing means providing a guard surface extending parallel to said blade means, said frame means including mounting portions retained in said housing means by embedding of said mounting portions in said housing means.

4. A shaving unit in accordance with claim 3 and including a handle unremovably secured to said housing.

5. A shaving unit comprising narrow elongated blade means having a cutting edge means thereon, frame means including a thin elongated first portion, a thin elongated second portion, said first and second portions being joined by thin elongated end portions, said first, second and end portions defining a slot therebetween, said first portion having a support portion having a substantially flat surface thereon, said blade means being permanently secured over its full length to said surface and being over its full length adjacent thereto, said cutting edge means projecting clear of said support portion, and plastic housing means disposed about said frame means and retaining said frame means and said blade means therein, said housing means providing a guard surface extending parallel to said blade means, said frame means including mounting portions which are straight and aligned with said support portion, said housing having groove means for retaining said mounting portions therein.

6. A shaving unit in accordance with claim 5 and including a handle unremovably secured to said housing.

7. A shaving unit comprising narrow elongated blade means having a cutting edge means thereon, frame means including a thin elongated first portion, a thin elongated second portion, said first and second portions being joined by thin elongated end portions, said first, second and end portions defining a slot therebetween, said first portion having a support portion having a substantially flat surface thereon, said blade means being permanently secured over its full length to said surface and being over its full length adjacent thereto, said cutting edge means projecting clear of said support portion, and housing means disposed about said frame means and retaining said frame means and said blade means therein, said housing means providing a guard surface extending parallel to said blade means, said housing means further providing coupling means for detachably securing said unit to a handle, said coupling means comprising a tongue projecting from said unit.

8. A shaving unit comprising narrow elongated blade means having a cutting edge means thereon, frame means including a thin elongated first portion, a thin elongated second portion, said first and second portions being joined by thin elongated end portions, said first, second and end portions defining a slot therebetween, said first portion having a support portion having a substantially flat surface thereon, said blade means being permanently secured over its full length to said surface and being over its full length adjacent thereto, said cutting edge means projecting clear of said support portion, and housing means disposed about said frame means and retaining said frame means and said blade means therein, said housing means providing a guard surface extending parallel to said blade means, said housing means further providing coupling means for detachably securing said unit to a handle, said coupling means comprising a pair of channels extending longitudinally of said housing.

* * * * *